United States Patent [19]

DeLage

[11] Patent Number: 4,562,590

[45] Date of Patent: Dec. 31, 1985

[54] WATER-RESISTANT DEVICE FOR PROTECTING AN ELECTRONIC SOUND PRODUCING APPARATUS AND LOUDSPEAKER SYSTEM

[76] Inventor: Frank DeLage, 4108 Ohio Ave., Tampa, Fla. 33616

[21] Appl. No.: 582,389

[22] Filed: Feb. 22, 1984

[51] Int. Cl.[4] ..... H04K 1/02

[52] U.S. Cl. ..... 381/90; 179/146 E; 179/178; 179/179; 179/184

[58] Field of Search ..... 381/90; 179/179, 178, 179/180, 184, 146 E, 115.5 BS; 455/89, 90

[56] References Cited

U.S. PATENT DOCUMENTS

| | | | |
|---|---|---|---|
| 3,162,813 | 12/1964 | Piccinini | 455/157 |
| 3,174,129 | 3/1965 | Laughlin et al. | 179/179 |
| 3,391,754 | 7/1968 | Montanaro | 179/181 |
| 3,789,166 | 1/1974 | Sebesta | 179/184 |
| 3,983,483 | 9/1976 | Pando | 455/89 |
| 3,987,258 | 10/1976 | Tsutsui et al. | 179/180 |
| 4,123,622 | 10/1978 | MacLeod | 179/146 E |
| 4,225,970 | 9/1980 | Jaramillo et al. | 455/89 |
| 4,321,433 | 3/1982 | King | 179/184 |

FOREIGN PATENT DOCUMENTS

| | | | |
|---|---|---|---|
| 3046627 | 7/1982 | Fed. Rep. of Germany | 179/179 |

*Primary Examiner*—Thomas W. Brown
*Assistant Examiner*—Danita R. Byrd
*Attorney, Agent, or Firm*—Frijouf, Rust & Pyle

[57] ABSTRACT

In a water resistant device for protecting an electronic sound producing apparatus and loudspeaker system, the water resistant device includes a container for containing the sound producing apparatus. A removable lid cooperating with the container for sealing the sound producing apparatus within the container. A first loudspeaker of the loudspeaker system is electrically connected to the sound producing apparatus and a water resistant first loudspeaker enclosure houses the first loudspeaker, the first enclosure being removably secured to the container.

19 Claims, 9 Drawing Figures

WATER-RESISTANT DEVICE FOR PROTECTING AN ELECTRONIC SOUND PRODUCING APPARATUS AND LOUDSPEAKER SYSTEM

BACKGROUND OF THE INVENTION

1. Field of the Invention

This invention relates to a water resistant device for protecting an electronic sound producing apparatus and loudspeaker system from the deleterious effects of water. More specifically, this invention relates to a water resistant device for protecting a radio, tape recorder or the like from rain, surf or the like.

2. Information Disclosure Statement

Yachtsmen and those who enjoy water sports and the like are familiar with the problems encountered with the on-board operation of a radio or tape recorder. Most tape recorders, radios and small electronic sound producing apparatus are designed primarily for use in a dry environment. When such apparatus are used at sea or while sailing on a lake, splashing of water on the radio, tape recorder or the like has a serious effect on the life of such apparatus. Water entering the apparatus may cause short circuiting and/or corrosion of the internal components of the apparatus.

In addition to the deleterious effect of rain, sea spray and the like upon the radio or tape recorder, another problem exists with the use of such an apparatus in these adverse environmental conditions. Many an expensive radio or tape recorder has been lost overboard due to an unexpected rolling motion of the boat, and even in the event of a radio being tied to a float, the effect of the water upon the internal working of the radio usually renders the same irrepairable.

The present invention seeks to overcome these problems by providing a water resistant device for protecting the electronic sound producing apparatus from the deleterious effects of rain, sea spray or the like.

Although in the prior art several proposals have been made to render a radio or the like splash proof, such splash proof casings have always been tailor made to a particular design of radio, tape recorder or the like.

U.S. Pat. No. 3,162,813 to Piccinini, teaches a radio receiving apparatus with a tightly sealed floating case. The radio is operated by means of control knobs which tune and control the radio through sealed control rods. The floatable casing is specially made for the particular size loudspeaker and radio receiver.

U.S. Pat. No. 4,225,970 to Jaramillo et al teaches a splash proof portable two way data terminal and radio in which the casing is sealed by means of a waterproof front panel incorporating a seal and a gasket. This splash proof radio case is of a particular configuration and will be suitable only for the type of radio for which the casing is manufactured.

U.S. Pat. No. 3,987,258 to Tsutsui et al assigned to Matsushita Industrial Electric Company, Ltd. teaches a casing that is permeable to gas but impermeable to liquids. The casing includes an integral speaker and a radio circuit incorporated within the casing. The casing is specifically built for the type of radio incorporated within the casing and would not be suitable for incorporating therein a tape recorder or a similar electronic sound producing apparatus of a different size.

U.S. Pat. No. 3,391,754 to Montanaro discloses a waterproof radio receiver with an automatically sealed housing. FIG. 5 shows a control knob of the radio receiver with a control arm passing through an O-ring seal in the casing of the radio receiver. This radio receiver housing would only accomodate a radio recever of one specific size and could not be used for housing an apparatus of a different size or shape.

It is the primary object of this invention to provide a water resistant device for protecting an electronic sound producing apparatus and a loud speaker system from the deleterious effects of water, and thereby overcomes the aforementioned inadequacies of the prior art devices and provides an improvement which significantly contributes to the reliability of the system and protects such electronic sound producing apparatus from damage upon impact with a solid surface.

Another object of the present invention is the provision of a water resistant device for protecting a radio, tape recorder or the like against the damaging effects of rain, sea water or spray when such sound producing apparatus is used outdoors.

Another object of the present invention is the provision of a water resistant device for an electronic sound producing apparatus which will float when dropped into water.

Another object of the present invention is the provision of a container for containing a sound producing apparatus having a removable lid for sealing the sound producing apparatus within the container.

Another object of the present invention is the provision of a container for housing a sound producing apparatus and at least one loudspeaker electrically connected to the sound producing apparatus within the container.

Another object of the present invention is the provision of an external layer of shock resistant material over the entire surface of the container.

Another object of the present invention is the provision of a plurality of a VELCRO-type strips of material disposed adjacent the container and the loudspeaker enclosure respectively for permitting the removable attachment of the loudspeaker to the container. VELCRO is a Registered Trademark.

A further object of the present invention is the provision of inverted T-shaped strips of material disposed adjacent the side the loudspeaker which enhances the stabilization of the loudspeakers relative the container.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention within the scope of the invention. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The water resistant device of the present invention is defined by the appended claims with a specific embodiment shown in the attached drawings. For the purpose of summarizing the invention, the invention relates to a water resistant device for protecting an electronic sound producing apparatus and loudspeaker system from the deleterious effects of water or the like. The water resistant device includes container means for containing the sound producing apparatus and a removable lid cooperating with the container for sealing the sound producing apparatus within the container. A first loudspeaker, contained within a water resistant first loudspeaker enclosure is removably secured to the container.

In a more specific embodiment of the invention, the container includes an external layer of shock resistant material such as a polymeric material. The container includes a base and sidewall, and a fastener means for removably securing the first loudspeaker enclosure to the container. The fastener means includes a first and a second strip of material disposed respectively adjacent the container and the first loudspeaker enclosure. The first strip of material is of rectangular configuration and is attached to the side of the container. The second strip of material is of inverted T-shaped configuration and is attached to the loudspeaker enclosure. The first and second strips are of the interlocking hook and loop type sold under the registered trademark VELCRO.

More particularly, a pair of the first strips of material are disposed on opposite sides of the container. A second loudspeaker of the loudspeaker system is enclosed within a second loudspeaker enclosure. A pair of the second strips of material are disposed adjacent the loudspeaker enclosures such that the first and the second loudspeaker enclosures are removably secured to opposite sides of the container. A third strip of material of inverted U-shaped configuration is fabricated from VELCRO and is removably secured adjacent the first strip of material and between the first and second strips when the loudspeaker enclosure is attached to the conatiner. Each of the third strips of material further include an extension defining a hole therein. A button extends through and is anchored within the hole. A slotted fastener lockably engages the button and is secured to an adjustable strap is secured to the slotted fastener for carrying the first container.

The lid includes a peripheral channel which engages with an edge of the sidewall of the container, the edge being remote from the base such that a waterproof seal is framed between the container and the lid. The lid further includes a finger hook for facilitating removal of the lid from the container. The lid also includes a first and a second aperture and a first and a second electrical socket extending through the aperture and an electrical jack plug for electrically connecting the sound producing apparatus to the first and second electrical sockets, respectively. Each of the electrical sockets is sealed within the respective apertures by means of a grommet. The lid further includes a third and a fourth aperture through which a flexible plug extends. A first and a second O-ring slidably engage the flexible plug to lock the plug relative to the lid and a third and a fourth O-ring respectively slide along the distal ends of the plug to cooperate with the distal ends of the plug to seal the first and the second electrical sockets. Each of the first and the second loudspeaker enclosures includes a removable wall releasably secured to the first loudspeaker enclosure and an upstanding lip extending from the removable wall. The lip of each wall defines an opening. A membrane extends across the opening for permitting the passage of sound waves from the first loudspeaker through the membrane but inhibits the ingress of water into the first loudspeaker enclosure. A sculptured foam cover is affixed to the removable wall for protecting the membrane and for permitting the passage of sound waves from the first loudspeaker through the foam cover. The loudspeaker enclosures each include a packing of rigid foam which surrounds and protects the respective loudspeakers.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through the several views of the drawings.

DETAILED DESCRIPTION

Figure 1:
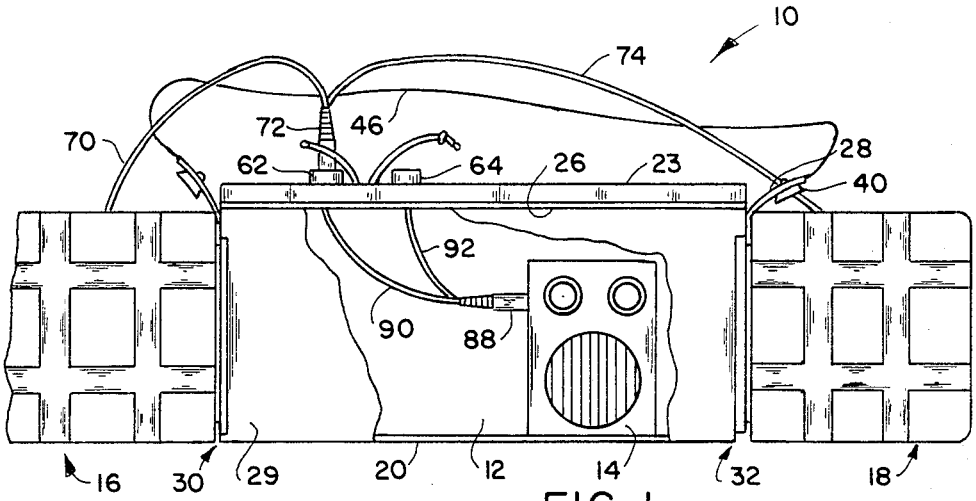
FIG. 1 is a front elevational view partially cut away of the water resistant device according to the present invention.
Figure 2:
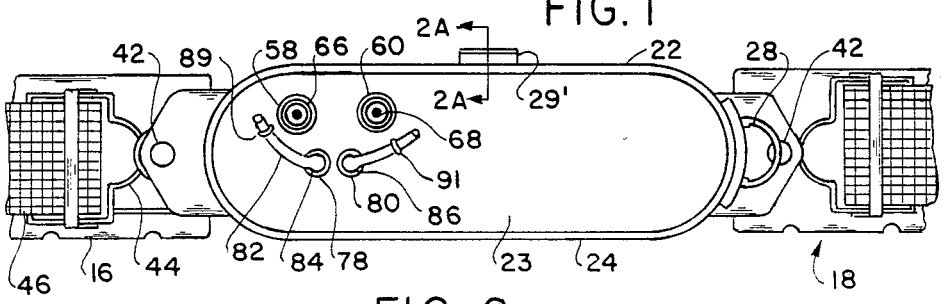
FIG. 2 is a plan view of the device shown in FIG. 1.

FIG. 1 is a front elevational view partially cut away of the water resistant device generally designated 10. The water resistant device 10 includes a container 12 for containing radio, tape recorder or other electronic sound producing apparatus 14. A first and a second loudspeaker enclosure generally designated 16 and 18, respectively, are shown removably secured to opposite sides of the container 12. The container 12 includes a base 20 and a sidewall 22 as shown in FIG. 2, the sidewall 22 extending upwardly from the base 20. A lid 23 of the container 12 cooperates with the container 12 to form a waterproof seal therewith. A peripheral channel 24 of the lid 23 as shown in FIG. 2, cooperates with the edge 26 of the sidewall 22 to provide a waterproof seal between the lid 23 and the container 12 when the lid 23 is secured relative the container 12. The removable lid 23 includes a finger hook 28 shown more particularly with reference to FIG. 2. The container 12 may be of a plastics material and includes an external layer 29 of shock resistant material such as a polymeric material.

Figure 2A:
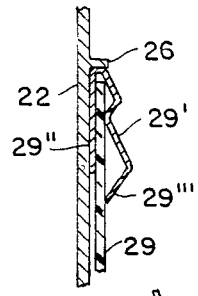
FIG. 2A is a sectional view of the support clip taken on the line 2A—2A of FIG. 2.

FIG. 2A is a sectional view taken on the line 2A—2A of FIG. 2 and shows a support clip generally designated 29' disposed adjacent the sidewall 22 with the top of the clip 29' abutting against the edge 26. The clip 29' includes a first and a second arm 29'' and 29''' respectively and the external layer 29 of shock resistant material is disposed between the arms 29'' and 20'''. In manufacturing the device of the present invention it has been found that when the layer 29 is secured to the container 12 by adhesive, the clip 29' is adequately anchored to the container 12. The clip 29' is useful not only for attaching the container to a user's belt or the like or to a line clip or similar guard rope of a sailboat, but it also is useful for supporting the various leads when the device is not being used.

Figure 3:
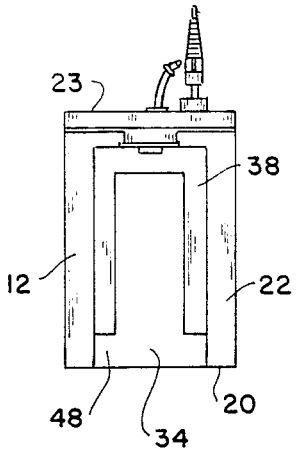
FIG. 3 is a right side elevational view of the container shown in FIG. 1 with a loudspeaker enclosure removed.
Figure 4:
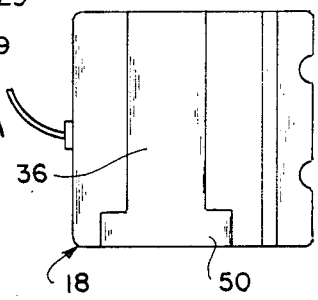
FIG. 4 is a side elevational view of one of the loudspeaker enclosures.
Figure 5:
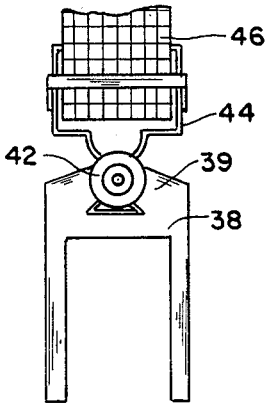
FIG. 5 is an enlarged side elevational view of the third strip of material and the strap.

The loudspeaker enclosures 16 and 18 are removably secured to opposite sides of the container 12 by fastening means generally designated 30 and 32, respectively, to be described hereinafter. The fastening means generally designated 32 includes a rectangular first strip of material 34 as shown in FIG. 3 which is glued or otherwised attached to the outer surface of the external layer 29 of the container 12. The strip of material 34 may be of the type sold under the registered trademark VELCRO. A second piece of material 36 of inverted T-shaped configuration is shown particularly in FIG. 4. The second strip of material 36 which is glued to the side of the loudspeaker enclosure 18 cooperates with the first strip of material 34 by the interengagement of the respective hooks and loops to form a removably secured attachment of the enclosure 18 to the container 12. A third strip of material 38, shown more particulary in FIG. 5, is of inverted U-shaped configuration. The third strip 38 is of VELCRO type material and is releasably attached to the rectangular first strip 34, as shown particulrly in FIG. 3. When the third strip 38 is attached to the first strip 34, an inverted T-shaped portion of the first strip 34 is left exposed for cooperation with the inverted T-shaped second strip of material 36 secured to the enclosure 18. The third strip of material 38 includes an extension 39 which defines a hole 40 shown in FIG. 5. A button 42 shown in FIG. 5 extends through the hole 40 and is lockably engaged by a slotted fastener 44. An adjustable strap 46 is secured to the slotted fastener 44 and extends from the fastener means 32 towards the corresponding fastener means 30 on the opposite side of the container 12 such that the adjustable strap 46 can serve as a carrying strap for the container 12 and the attached loudspeaker enclosures 16 and 18, respectively. When the loudspeaker enclosures 16 and 18 are attached to the corresponding sides of the container 12, the lateral portion 48 of the first strip of material 34 cooperates with the cross bar portion 50 of the second strip of material 36 to stabilize the enclosure 18 relative the container 12.

As shown particularly in FIGS. 1-3, the lid 23 defines a first and a second aperture 58 and 60, respectively. Rubber grommets 62 and 64 respectively, as shown in FIG. 1, extend through the apertures 58 and 60 and a first and a second electrical socket 66 and 68, respectively, are sealingly engaged within the apertures 58 and 60. A double conductor first electric lead 70 is electrically connected to the loudspeaker within the first loudspeaker enclosure 16 and extends from the loudspeaker enclosure 16 and terminates in a first jack plug 72. The jack plug 72 cooperates with the first electric socket 66 such that an electrical connection is made between the first loudspeaker within the first loudspeaker enclosure 16 and the electric socket 66. A double conductor second electric lead 74 extends from the second loudspeaker contained within the second loudspeaker enclosure 18 and also terminates in the first jack plug 72 which is receivably connected to the first electrical socket 66 such that the second loudspeaker is electrically connected to the first socket 66. If a third and fourth loudspeaker is to be used with the device of the present invention, the third and fourth loudspeakers are electrically connected in a similar manner to the first and second loudspeakers. However, the third and fourth loudspeakers are plugged into the second electrical socket 68 by means of a second jack plug (not shown). The lid 23 further defines a third and a fourth aperture 78 and 80, respectively. A flexible plug means 82 is looped through the third and fourth apertures 78 and 80 as shown in FIG. 2 and the flexible plug means 82 is anchored to the lid 23 by means of a first and a second O-ring 84 and 86, respectively, which slide over the distal ends of the flexible plug means 82 until the O-rings 84 and 86 seat against the top surface of the lid 23. A third and a fourth O-ring 89 and 91, respectively, slide over the surface of the flexible plug means 82 such that when the first and the second jack plugs are not secured within the electrical sockets 66 and 68, respectively, the two distal ends of the flexible plug means 82 are wedged within the electric sockets 66 and 68, respectively, and the third and fourth O-rings 89 and 91, respectively, form a water tight seal with the electric sockets 66 and 68, respectively. As shown more particularly in FIG. 1, the electric sockets 66 and 68, respectively, are connected to a third jack plug 88 by means of electrical leads 90 and 92, respectively. Each of the electrical leads 90 and 92 include three electrical conductors such that lead 90 includes three conductors of which one is a ground electrically connected by means of jack plug 72 to the common ground conductor of leads 70 and 74 respectively. The third jack plug 88 electrically connects into the loudspeaker output socket of a radio or the like 14 shown representatively in FIG. 1.

The electrical leads 70 and 74 preferably include a built-in antenna for FM reception extending along the length thereof such that in use of the device it is preferable to leave the leads 70 and 74 uncoiled. The antenna may either be one or other of the conductors or may be a separate conductor.

Figure 6:
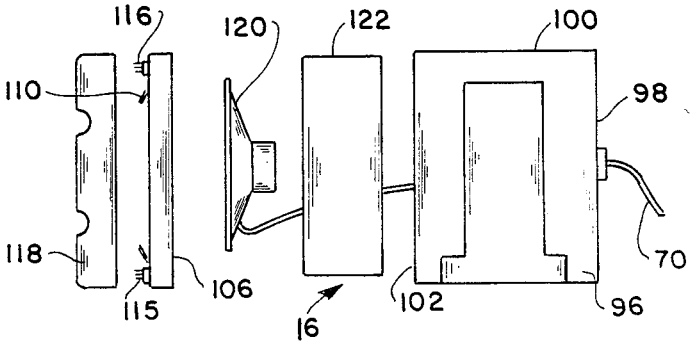
FIG. 6 is an exploded side elevational view of the loudspeaker enclosure showing the loudspeaker housed within the enclosure.
Figure 7:
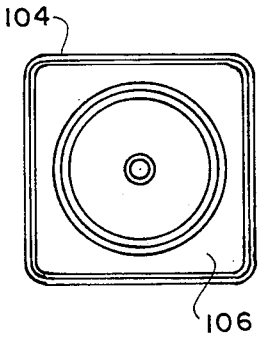
FIG. 7 is a front elevational view of one of the loudspeaker enclosures with the foam cover removed.
Figure 8:
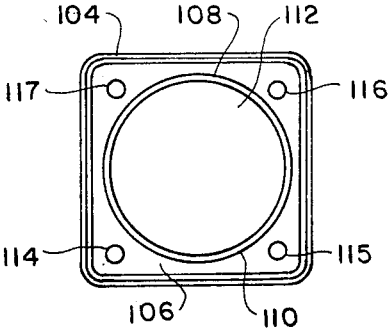
FIG. 8 is a front elevational view of one of the enclosures showing the removable wall attached to the enclosure.

The loudspeaker enclosures 16 and 18, respectively, are identical in construction except for the positioning of the fastening means 30 and 32, respectively, which are fastened on the opposite sides of the container 12 to cooperate with the corresponding fastening means on the sides of the container 12. The second loudspeaker enclosure 18 is shown in FIG. 4. The first loudspeaker enclosure 16 shown in FIG. 6 includes a box 96 having a back 98 and a wall 100 extending from the back 98. A peripheral edge 102 of the wall 100 cooperates with a groove defined by the peripheral edge of a removable wall 106, the removable wall 106 enclosing the box 96. The removable wall 106 defines a central opening 108 as shown in FIG. 8. An upstanding lip 110 extends around the circumference of the opening 108 and a membrane 112 extends across the removable wall 106 and the opening 108 for permitting passage of sound waves through the membrane but inhibiting the ingress of water into the interior of the box 96. A plurality of plastic studs 114 to 117 are secured to the removable wall 106 and include forwardly extending spikes for securing a sculptured foam cover 118 against the front of the removable wall 106. The sculptured foam cover 118 not only protects the front of the removable wall 106 and the central membrane 112, but also enhances the appearance of the first loudspeaker 16. As shown more particularly in FIG. 6 which is an exploded side elevational view of the first loudspeaker enclosure 16, a first loudspeaker 120 is supported by a preformed block 122 of rigid foam material. An electrical lead 70 extends from the first speaker 120 through the back 98 of the first loudspeaker enclosure 16. The removable wall 106 cooperates with peripheral edge 102 of the box 96 and the sculptured foam cover 118 is pressed against the front of the removable wall 106 such that the studs 114 to 117 penetrate into the foam of the cover 118 and retain the cover 118 in position. The upstanding lip 110 presses against the rear surface of the sculptured foam cover 118 to keep the same at a distance from the membrane 112 in order to allow the membrane 112 to oscillate.

In use of the device, the lid 23 is removed from the container 12 by applying a pulling force to the finger hook 28. The radio 14, tape recorder or other small electronic sound producing apparatus is placed within the container 12, and the third jack plug 88 is connected electrically to the loudspeaker output socket of the radio 14 or the like. The first jack plug 72 is plugged into the electrical socket 66 such that the first and second loudspeakers are electrically connected to the radio 14. The sound producing apparatus can be used with the loudspeaker enclosures 16 and 18 attached to the container 12 or the loudspeaker enclosures 16 and 18, respectively, may be detached from the container 12 and placed at such a location to provide sound separation enhancement. The present invention provides a stereophonic system in which the speakers 16 and 18 can either be attached to the container 12 or can be detached from the same.

The container 12 can be utilized not only for the storage and waterproofing of a radio, tape recorder or electronic sound producing apparatus or the like, but it may also container headphones, sunglasses, cassette tapes, cigarettes, matches, fishing tackle, keys and other small articles which could be damaged by salt water or the like. The device of the present invention has particular application with regard to the provision of a waterproof, stereo system for use on board a yacht or sailing boat. The fastening means for attaching the loudspeaker enclosures to the container are preferably made from a VELCRO-like material as this material is resistant to the damaging effects caused by water and salt. The fastening means are strong enough to adequately support the loudspeaker enclosures against the sides of the container 12 but permit the ready detachment of the speakers from the container 12 when the loudspeakers are not required as is the case when listening to the radio or tape recorder through headphones or when the loudspeakers are to be spaced relative each other to enhance the sound separation. The membrane extending across the removable wall is a waffled, high density plastic film, and the upstanding lip extending from the removable wall separates the sculptured foam cover from the membrane. The loudspeaker enclosures may be covered with a layer of polymeric material of a type similar to that used to cover the main cover 12.

The present invention provides a significant improvement over the prior art devices which have not provided a waterproof stereophonic enclosure for the reception of a radio or tape recorder of various sizes and shapes. The prior art devices have always been purposely built to receive a specific sound producing apparatus of a predetermined dimension.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A water resistant device for protecting an electronic sound producing apparatus and loudspeaker system from the deleterious effect of water, said device comprising in combination:

a container means for containing the sound producing apparatus, said container means further including:

an external layer of shock resistant material;

a removable lid means cooperating with said container means for sealing the sound producing apparatus within said container means;

a first loudspeaker of the loudspeaker system, said loudspeaker being electrically connected to the sound producing apparatus; and a water resistant first loudspeaker enclosure for housing said first loudspeaker, said first enclosure being removably secured to said container means.

2. A water resistant device as set forth in claim 1 wherein said external layer of shock resistant material is of a polymeric material.

3. A water resistant device as set forth in claim 1 wherein said external layer of shock resistant material is applied to the entire outer surface of said container means.

4. A water resistant device as set forth in claim 1 wherein said container means further includes:

a base; and a sidewall extending from said base.

5. A water resistant device as set forth in claim 1 wherein said container means further includes fastener means for removably securing said first loudspeaker enclosure to said container means.

6. A water resistant device as set forth in claim 5 wherein said fastener means further includes a plurality of interengaging hooks and loops which permit the removable attachment of said first loudspeaker enclosure to said container means.

7. A water resistant device as set forth in claim 6 wherein said fastener means further includes a first and a second strip of material disposed respectively adjacent said container means and said first loudspeaker enclosure, said interengaging hooks and loops extending towards each other from said strips when said first loudspeaker enclosure is attached to said container means.

8. A water resistant device as set forth in claim 7 wherein said second strip of material is of inverted T-shaped configuration for stabilizing said first loudspeaker enclosure relative said container means when said first loudspeaker enclosure is attached to said container means.

9. A water resistant device as set forth in claim 8 wherein said container means further includes:

a pair of said first strips of material, said first strips being disposed on opposite sides of said container means;

a second loudspeaker of the loudspeaker system;

a water resistant second loudspeaker enclosure for housing said second loudspeaker;

a pair of said second strips of material, said second strips being disposed respectively on said first and said second loudspeaker enclosures; and said first and said second strips of materials respectively interengaging to removably secure said first and said second loudspeaker enclosures adjacent said opposite sides of said container means.

10. A water resistant device as set forth in claim 9, including:

a pair of inverted U-shaped third strips of material, said third strips being detachably fastened to said first strips of material;

an extension extending from the base of each of said third strips of material;

a hole defined by said extension;

a button extending through and anchored by said hole;

a slotted fastener lockably engaging said button; and an adjustable strap means secured to said slotted fastener for carrying said first container means.

11. A water resistant device as set forth in claim 4 wherein said removable lid means further includes:

a peripheral channel;

an edge of said sidewall, said edge being disposed remote from said base, said edge cooperating with said peripheral channel; and a waterproof seal disposed between said container means and said lid means.

12. A water resistant device as set forth in claim 11 wherein said removable lid means further includes a finger hook for facilitating removal of said lid means from said container means.

13. A water resistant device as set forth in claim 11 wherein said removable lid means further includes:

a first aperture defined by said lid means;

a first electrical socket extending through said first aperture; and an electrical jack plug means for electrically connecting the sound producing apparatus to said first electrical socket.

14. A water resistant device as set forth in claim 13 wherein said removable lid means further includes a first grommet disposed in said first aperture for sealingly engaging said first electrical socket with said first aperture.

15. A water resistant device as set forth in claim 13 further including:

a second aperture;

a second electrical socket extending through said second aperture, said second electric socket being electrically connected to said jack plug means;

a third and a fourth aperture defined by said lid means;

a flexible plug means looped through said third and said fourth apertures for plugging the first and the second electric sockets, said plug means being of uniform circular cross sectional configuration;

a first and a second O-ring for sliding along the distal ends of said plug means respectively, to lock said plug means relative said lid means and to cooperate with said plug means to seal said third and said fourth apertures; and a third and a fourth O-ring for sliding along the distal ends of said plug means, respectively, to cooperate with said distal ends of said plug means and said first and said second electrical sockets to seal said distal ends relative said first and said second sockets.

16. A water resistant device as set forth in claim 1 wherein said first loudspeaker enclosure further includes:

a removable wall releasably secured to said first loudspeaker enclosure;

an upstanding lip extending from said removable wall;

an opening defined by said lip;

a membrane extending across said opening for permitting the passage of sound waves from the first loudspeaker therethrough but inhibiting the ingress of water into said first enclosure; and a sculptured foam cover affixed to said removable wall for protecting said membrane and for permitting the passage of sound waves from said first loudspeaker through said foam cover.

17. A water resistant device as set forth in claim 16 further including:

rigid foam packing for supporting said first loudspeaker within said first loudspeaker enclosure;

a plurality of securing means disposed adjacent said removable wall for securing said sculptured foam adjacent said removable wall; and an external layer of shock resistant material covering said first loudspeaker enclosure for protecting said first loudspeaker enclosure against abrasion and shock.

18. A water resistant device for protecting an electronic sound producing apparatus and loudspeaker system from the deleterious effects of water, said device comprising in combination:

container means for containing the sound producing apparatus;

a removable lip means cooperating with said container means for sealing the sound producing apparatus within said container means;

a first aperture defined by said lip means;

a first electrical socket extending through said first aperture;

an electrical jack plug means electrically connected to the sound producing apparatus, said jack plug means being electrically connected to said first electrical socket; and a water resistant first loudspeaker enclosure removably secured to said container means, the loudspeaker system being electrically connected to said first electrical socket.

19. A water resistant device for protecting an electronic sound producing apparatus and loudspeaker system from the deleterious effects of water, said device comprising in combination a container means for containing the sound producing apparatus;

an external layer of polymeric material applied to the entire outer surface of said container means for protecting said container means form abrasion and shock;

a removable lid means cooperating with said container means for sealing the sound producing apparatus within said container means;

a water resistant first and second loudspeaker enclosure removably secured to opposite sides of said container means, the loudspeaker system being electrically connected to the sound producing apparatus;

fastening means for removably securing said first and second loudspeaker enclosures adjacent said container means;

a first and a second aperture defined by said lid means;

a first and a second electrical socket extending respectively through said first and said second apertures;

an electrical jack plug means electrically connected to the sound producing apparatus, said jack plug means being electrically connected to said first and said second electrical sockets; and means for electrically connecting said first and said second electrical sockets to a first and a second loudspeaker of the loudspeaker system.

* * * * *